US005111729A

United States Patent [19]

Tassie

[11] Patent Number: 5,111,729

[45] Date of Patent: May 12, 1992

[54] AMMUNITION STORAGE SYSTEM

[75] Inventor: Douglas P. Tassie, St. George, Vt.

[73] Assignee: General Electric Company, Burlington, Vt.

[21] Appl. No.: 592,740

[22] Filed: Oct. 4, 1990

[51] Int. Cl.[5] ..... F41A 9/75

[52] U.S. Cl. ..... 89/33.02

[58] Field of Search ..... 89/33.02, 33.1, 33.14, 89/33.16, 33.2, 34

[56] References Cited

U.S. PATENT DOCUMENTS

| | | | |
|---|---|---|---|
| 2,483,334 | 9/1949 | d'Assis-Fonseca et al. | 89/33.14 |
| 2,710,561 | 6/1955 | Dowd | 89/34 |
| 2,833,182 | 5/1958 | Houston et al. | 89/33.02 |
| 2,993,415 | 7/1961 | Panicci et al. | 89/33.2 |
| 3,333,506 | 8/1967 | Henshaw et al. | 89/33.25 |
| 3,427,923 | 2/1969 | Meyer et al. | 89/33.02 |
| 3,498,178 | 3/1970 | Meyer et al. | 89/34 |
| 3,650,176 | 3/1972 | Lindner | 89/35.02 |
| 3,762,268 | 10/1973 | Gaye | 89/34 |
| 4,004,490 | 1/1977 | Dix et al. | 89/33.02 |
| 4,068,557 | 1/1978 | Montjallard et al. | 89/33.5 |
| 4,342,253 | 8/1982 | Kirkpatrick et al. | 89/12 |
| 4,413,546 | 11/1983 | Taylor | 89/33.02 |

*Primary Examiner*—Stephen C. Bentley
*Attorney, Agent, or Firm*—Stephen A. Young

[57] ABSTRACT

A helical storage system for linked ammunition, has no outer drum and only two moving parts, providing positive control of the rounds, low friction, and bi-directional load and unload.

9 Claims, 4 Drawing Sheets

FIG. 5
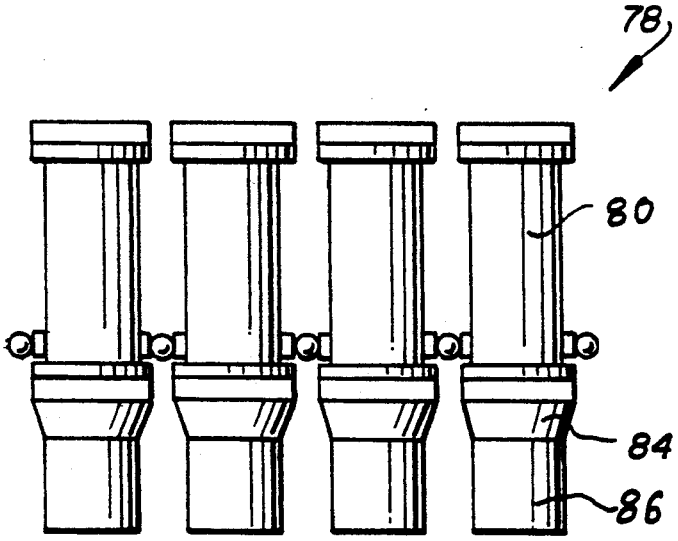
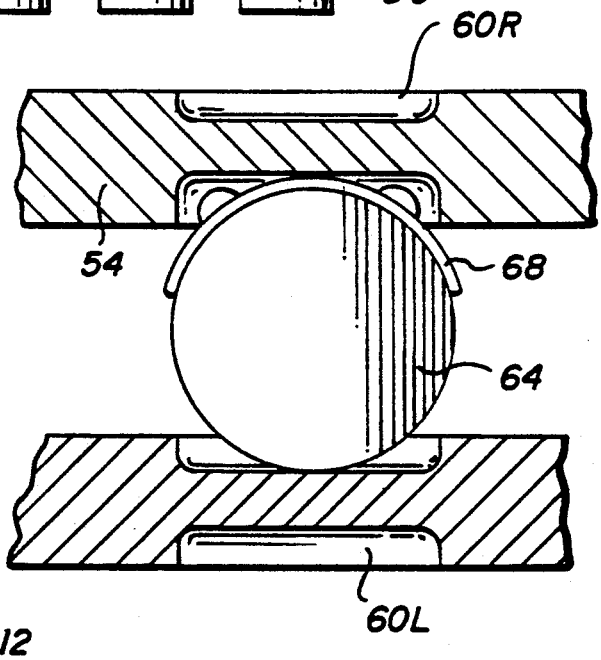
FIG. 4
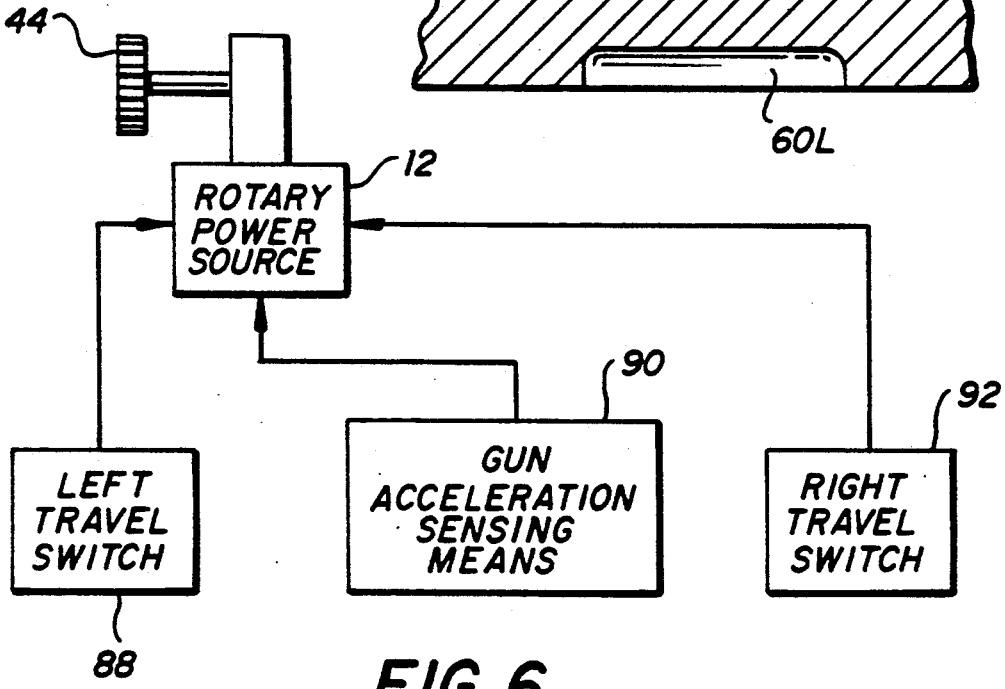
FIG. 6

AMMUNITION STORAGE SYSTEM

FIELD OF THE INVENTION

This invention relates to a helical storage system for linked rounds of ammunition which provides significant control of the rounds irrespective of the motion and attitude of the system.

PRIOR ART

Linked ammunition is typically stored in boxes and is folded in serpentine fashion in horizontal layers or draped in vertical layers. See, for example, U.S. Pat. No. 4,068,557 issued Jan. 17, 1978 to P. R. Montjallard et al, and U.S. Pat. No. 2,710,561 issued Jun. 14, 1955 to A. A. Dowd. Such a system is gravity sensitive and subject to jamming under the significant changes of motion and attitude which occur within the flight envelope of a helicopter. An early gravity sensitive version of a helical storage system is shown in U.S. Pat. No. 2,833,182 issued May 6, 1958 to C. E. Houston et al.

Here the belt of linked rounds is wrapped around a control core which rotates with the belt as it is wound on, or off, through a portal. A gravity insensitive system was provided for linkless ammunition in U.S. Pat. No. 2,993,415 issued Jul. 25, 1961 to E. W. Panicci et al. This has an inner helix rotating within the longitudinally extending fins of an outer drum. This system has many parts and is expensive, but has become the standard storage system for modern, high performance, fixed wing aircraft. See, e.g., U.S. Pat. No. 4,004,490 issued Jan. 25, 1977 to J. Dix et al. Similar systems having inner and outer rotating members and many moving parts are shown in U.S. Pat. No. 3,427,923 issued Feb. 18, 1969 to E. A. Meyer et al and U.S. Pat. No. 3,498,178 issued Mar. 3, 1970 to E. A. Meyer et al.

SUMMARY OF THE INVENTION

An object of this invention is to provide a highly reliable, gravity insensitive, inexpensive storage system for linked ammunition.

A feature of this invention is a helical storage system for linked ammunition, which has no outer drum and has only two moving parts providing positive control of the rounds, low friction, and bi-directional load and unload.

BRIEF DESCRIPTION OF THE DRAWINGS

FIG. 4 is a detail of the round and link locating pockets on mutually adjacent layers of the helical storage device;

FIG. 5 is a detail of the leader, for the belt of linked rounds of ammunition, of the helical storage device; and FIG. 6 is a schematic of the electrical circuit for controlling the rotary drive for the system

DESCRIPTION OF THE INVENTION

Figure 1:
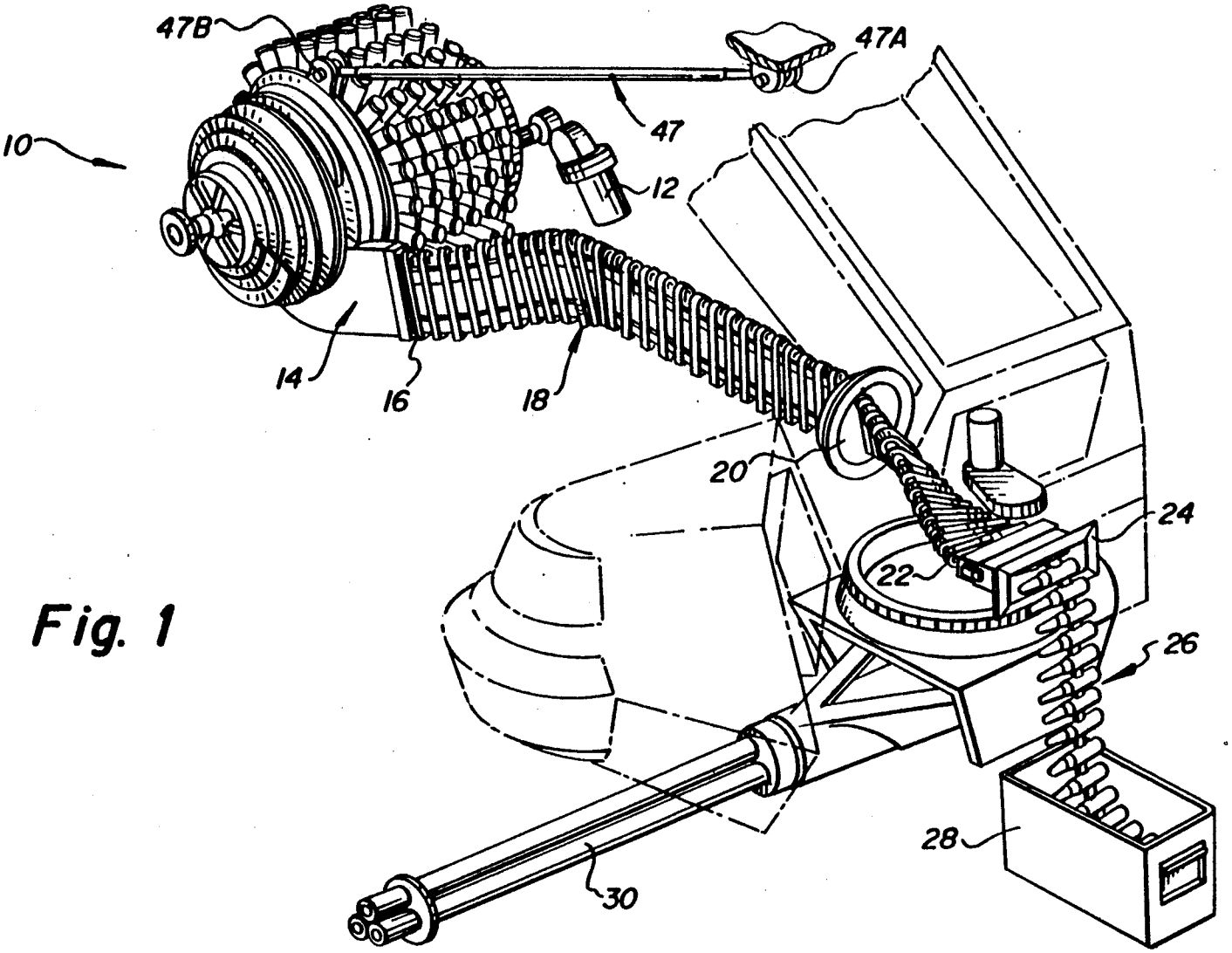
FIG. 1 is a perspective view of an ammunition storage system embodying this invention.

As seen in FIG. 1, the ammunition storage system comprises a rotary helical storage device 10 which is driven by a rotary power source 12 and has a guide and port assembly 14 to which is connected one end 16 of a chute 18, for linked ammunition, which is supported in a swivel 20. The other end 22 of the chute may alternatively be coupled to a bellmouth 24 as an aid in loading the belt 26 of linked ammunition out from a conventional ammunition box 28, or coupled to the stripping feeder (not shown) of a high rate of fire gun 30.

The gun may be a gatling type gun, as shown for example, in U.S. Pat. No. 4,342,253 issued Aug. 3, 1982 to R. C. Kirkpatrick et al.

The stripping feeder may be of the side stripping type, as shown, for example in U.S. Pat. No. 3,333,506 issued Aug. 1, 1967 to R. W. Henshaw et al.

The belt of ammunition may be formed of rounds of conventional cased ammunition held together by M14A2 links, which are similar to those shown in U.S. Pat. No. 3,650,176 issued Mar. 21, 1972 to G. Lindner.

The chute 18, and its respective ends and attachment devices, may be of the type shown in U.S. Pat. No. 3,762,268 issued Oct. 2, 1973 to J. H. Gaye.

The swivel 20 is a circular plate which is journaled for rotation about its longitudinal axis within an annular race with ball bearings. The chute is fixed to the plate through a rectangular aperture therein, and thus the chute is free to twist about the swivel's longitudinal axis and accommodate flexing in the chute when fixed to the feeder of the gun during movement of the gun in azimuth.

The rotary helical storage device 10 includes a multi-layered helix or helical fin 32 fixed to a central hub or tube 34 which is fixed to and between a pair of end plates 36, which are respectively journaled for rotation, on stub shafts 38, about longitudinal axis 40. One end plate 36 includes a driven ring gear 42, which is meshed with a drive gear 44, which is fixed to a drive shaft 46, which is driven by the rotary power source 12.

The helix 32 may be formed as a solid structure, e.g. machined out of aluminum plate, but preferably is formed of sheet material such as fiberglass reinforced plastic or formed of continuous rectangular ribbons of stock material as broadly taught in U.S. Pat. No. 4,004,490 issued Jan. 25, 1977 to J. Dix et al.

The guide and port assembly 14 is mounted on the helix 32 which rotates within the assembly. The assembly is substantially fixed by a strut 47, against rotation about axis 40 but is free to translate along axis 40 when so driven by the rotating helix. The assembly 14 includes a pair of side ring plates 48R and 48L which support on respective pins 50 a plurality of annularly spaced apart rollers 52. The side plates straddle for 360 degrees one layer of the helix and the rollers 52 ride on the periphery 54 of the layer. A tubular guide 55 of substantially rectangular open cross-section is fixed to the right side plate 48R and its aft end and top opening is aligned with the gap 58 defined by and between the next, on the right, two adjacent layers. The strut 47 has a swivel ball joint 47A at one end mounted to the aircraft structure, and a swivel ball joint 47B at its other end mounted to the assembly 14. The length of the strut 47 limits the angular displacement of the assembly 14 to no more than five degrees as it translates along the helix 32.

A plurality of pairs of mutually spaced apart side cavities 60R and 60L are formed into the mutually opposed side surface 62R and 62L which form the gap 58. Each side cavity 60R is adapted to receive an annular portion of the neck of the cartridge case 64 of a round of ammunition. The respective opposed side cavity 60L is adapted to receive an annular portion of the forward part 66 of the link 68. The projectile 70 is received within the gap 58. The longitudinal alignment of the link with the cartridge case is established by a tail inwardly extending rib 72 of the link engaged with the extractor groove 74 of the cartridge case. The radial alignment of the link and respective cartridge case in the gap 58 is established by a forward outwardly extending rib 76 of the link abutting the periphery 54 of the left adjacent layer of the helix.

Figure 3:
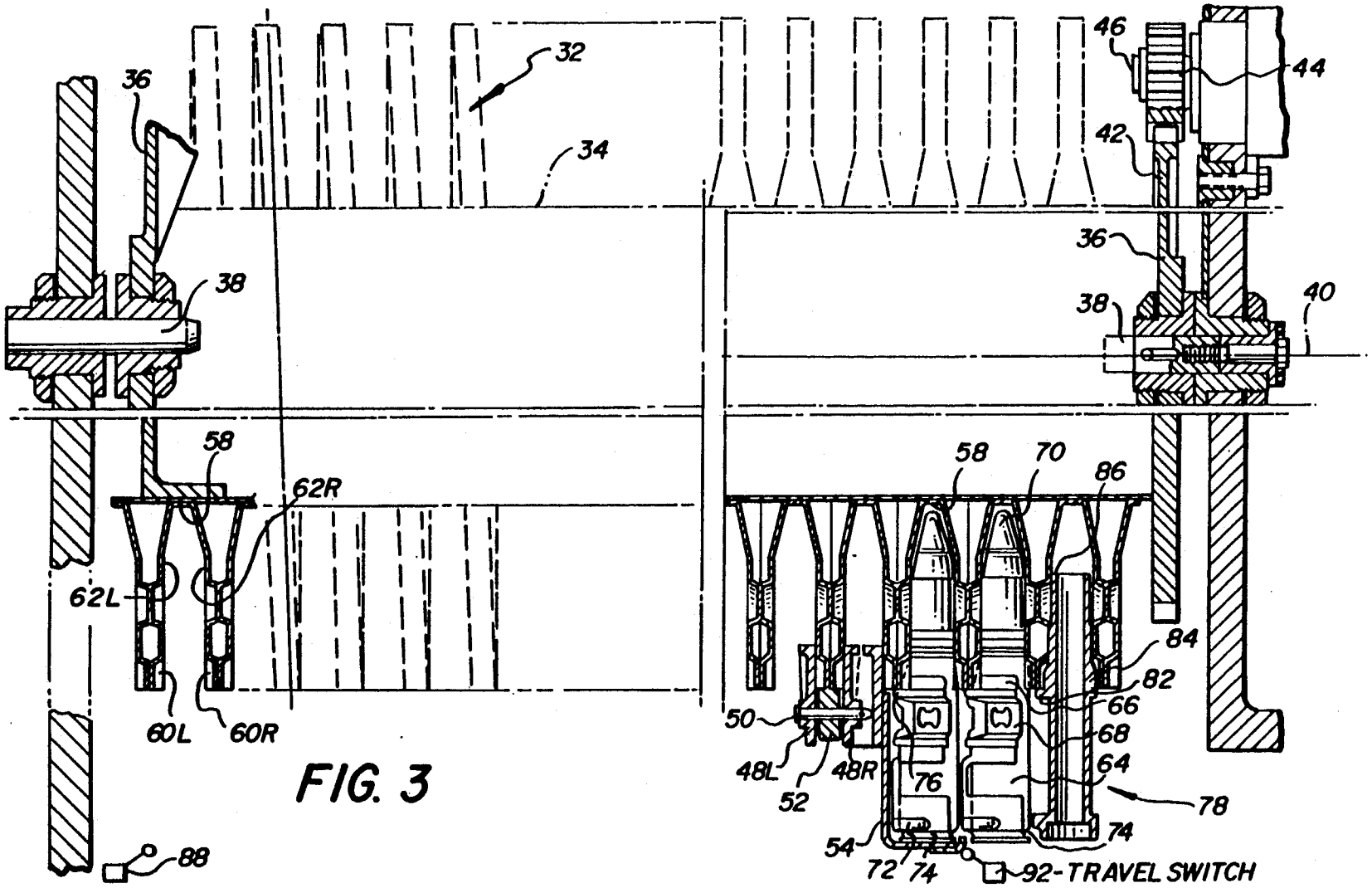
FIG. 3 is a broken away diametrical cross-section of the helical storage device.

To permit a belt of ammunition to be loaded through the bellmouth 24, through the chute 18 and into the helix 32, a leader assembly 78 is provided 10 as shown in FIGS. 5 and 3. The leader assembly comprises a plurality of round and link simulators 80. Each simulator 80 is a tube having an annular-radial projection 82 simulating the rib 76 of the link, an annulus 84 simulating the case neck and the link forward part 66 and a forward portion 86 simulating the projectile 70. The simulators are chained or wired together on a spacing or pitch identical to that of the linked-together rounds of ammunition.

The simulator 80 at one end of the leader assembly is fixed (as by a clip, not shown) into the end-most mutually opposed pair of side cavities 60R and 60L, that is, the two end-most layers of the helix adjacent the driven gear 44. The remaining simulators which serve as the running end, are respectively disposed in the next adjacent pairs of side cavities 60R and 60L and passed through the guide and port assembly and through the chute 18.

Figure 2:
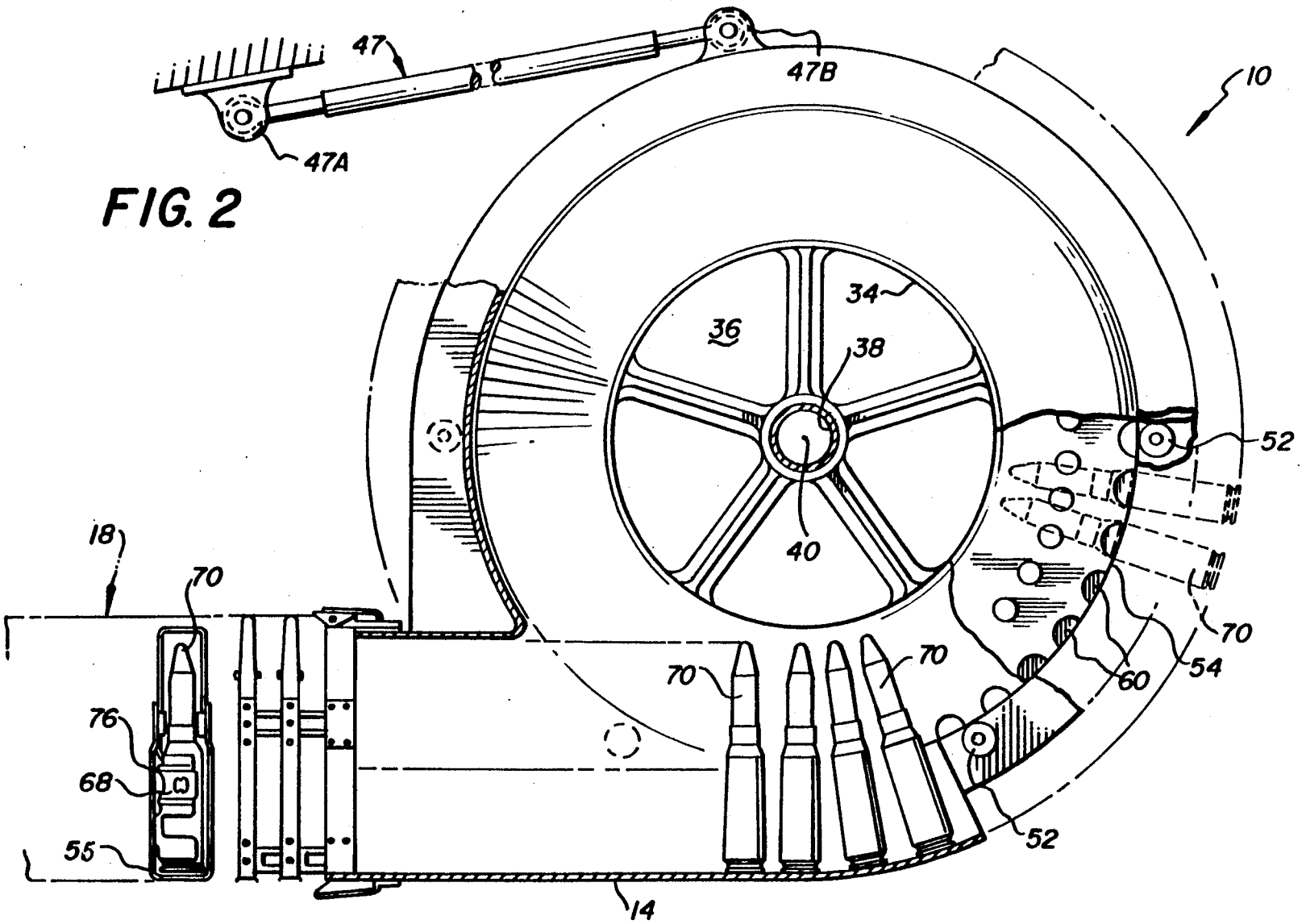
FIG. 2 is a broken away side view in elevation of the helical storage device.

To load the helix 32 with ammunition, the end 22 of the chute 18 is clipped to the bellmouth 24 10 with at least the running end last simulator 80 passing out of the bellmouth. The link 68 on the lead round of a belt of rounds in the ammo box 28 is snapped onto the last simulator to form a continuous belt of the leader assembly and the belt of rounds. The rotary power source 12 is energized to rotate the helix in the wind-up direction (counter-clockwise as seen in FIG. 2). As the helix rotates, the belt is drawn through the chute and each simulator and then each round, in sequence, is guided into the gap 58 and located between a respective pair of mutually opposed side cavities 60R and 60L. This process involves the guide and port assembly progressively being translated by the helix away from the driven gear to the end of the left-most layer of the helix as seen in FIG. 3. At this disposition, it opens an end-of-travel switch means 88 to de-energize the rotary power source 12. The running end of the belt of rounds extending from the bellmouth is delinked from any residual belt of rounds in the ammo box 28. The end 22 of the chute 18 is unclipped from the bellmouth and clipped to the entrance unit of the feeder of the gun and the leading round of ammunition is engaged with the entry sprocket of the feeder. The gun is then loaded as may be appropriate to its particular mode of operation to place the first round at its ready to fire disposition. In certain modes, the first round remains in the feeder until the gun trigger is pulled so as to keep the gun cleared except when actually firing.

Depending on the inertias of the system, the gun alone when firing will be adequate to drive the feeder to pull the belt of ammunition and unwind the helix. Any discrepancy between the initial acceleration of the gun and the initial acceleration of the helix and the belt may be accommodated by the inherent resiliency of the plurality of links in the running end of the belt. Alternatively, a means 90 to sense the acceleration of the gun may be provided to energize the rotary power source 12 to drive the helix with an unwind acceleration which matches the acceleration on the gun and thereby minimizes the stretching load on the running end of the belt. When the entire belt of ammunition has been expended, the guide and portal assembly 14 will be at its rightmost disposition, with the running end of the leader assembly extending through and out of the chute, and will open an end of travel switch means 92 to deenergize the rotary energy source 12. Alternatively, to decelerate the rotating mass of the helix 32, the end of travel switch means 88 and 92 may for a short time reverse energize the rotary energy source 12.

What is claimed is:

1. A storage system for a belt of linked together rounds of ammunition comprising:
   a base means;
   a helical fin having a plurality of uniformly spaced apart layers and journaled to said base means for rotation about its longitudinal axis;
   said layers of said helical fin defining a helical gap having a pair of mutually opposed helical side walls;
   said layers of said helical fin having a peripheral surface radially spaced from said longitudinal axis and defining the radial height of said helical gap;
   a plurality of pairs of mutually spaced apart cavities, said pairs being disposed sequentially along the helical length of said gap, each pair extending longitudinally into mutually opposed portions of said side walls and radially inwardly from said peripheral surface.

2. A system according to claim 1 wherein:
   said plurality of pairs of cavities are sequentially spaced apart at a uniform distance which is identical to the uniform distance at which the rounds of ammunition in the belt are spaced apart.

3. A system according to claim 2 wherein:
   one of said pair of cavities is so contoured and arranged as to mate with a portion of the neck of the round of ammunition, and the other of said pair of cavities is so contoured and arranged as to mate with a portion of the link on the round of ammunition.

4. A system according to claim 2 further including:
   guide and port means mounted for travel on and with respect to said helical fin, said means being constrained against rotation about said longitudinal axis of said helical fin and free for translation along said longitudinal axis.

5. A system according to claim 4 wherein:
   said guide and port means includes an aperture which is aligned with said gap, and has a mode of operation such that as said helical fin rotates about its said longitudinal axis, the guide and port means translates along said longitudinal axis to maintain said aperture in alignment with said gap.

6. A system according to claim 5 further including:
   a flexible chute, for passing a belt of linked together rounds of ammunition, having one end thereof fixed to said guide and port means and aligned with said aperture.

7. A system according to claim 6 further including:
   a leader assembly comprising a plurality of elements sequentially and flexibly coupled together at said uniform distance at which the rounds of ammunition in the belt are spaced apart, having the element forming one end thereof disposed in one of said pairs of mutually spaced apart cavities and fixed to said fin and the remaining elements in respective sequence adapted to fit in the respectively sequentially adjacent pairs of mutually spaced apart cavities and through said aperture in said guide and portal means and through the length of said chute when said guide and portal means is at one end of its translation along said longitudinal axis.

8. A system according to claim 7 wherein:

the element forming the other end of said leader assembly is adapted to be coupled to the round of ammunition at the leading end of the belt and when said helical fin is progressively rotated about its longitudinal axis the remaining elements are progressively sequentially disposed into respective sequentially adjacent pairs of mutually spaced apart cavities and the rounds of ammunition are likewise progressively drawn into and through said chute and said aperture and disposed in said pairs of cavities.

9. A system according to claim 6 further including:

support means having a first portion thereof fixed to said base means and a second portion thereof fixed to a portion of said chute and journaled for rotation with respect to said first portion about an axis of rotation which is the longitudinal axis of said portion of said chute, whereby said portion of said chute is supported and journaled for twisting about its said longitudinal axis with respect to said base means.

* * * * *